US006991551B2

(12) United States Patent
Tolentino et al.

(10) Patent No.: US 6,991,551 B2
(45) Date of Patent: Jan. 31, 2006

(54) COMPOSITE BALL BAT HAVING A METAL KNOB

(75) Inventors: Danny Tolentino, Los Angeles, CA (US); William B. Giannetti, Van Nuys, CA (US); Dewey Chauvin, Simi Valley, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/753,649

(22) Filed: Jan. 8, 2004

(65) Prior Publication Data

US 2005/0153800 A1 Jul. 14, 2005

(51) Int. Cl.
*A63B 59/06* (2006.01)

(52) U.S. Cl. ..... 473/167; 473/166

(58) Field of Classification Search ..... 473/564–568, 473/519, 520, 457
See application file for complete search history.

(56) References Cited

U.S. PATENT DOCUMENTS

| | | | | | |
|---|---|---|---|---|---|
| 2,195,681 | A | * | 4/1940 | Robarge | 473/564 |
| 3,116,926 | A | * | 1/1964 | Owen et al. | 473/457 |
| 3,479,030 | A | * | 11/1969 | Merola | 473/520 |
| 3,877,698 | A | * | 4/1975 | Volpe | 473/520 |
| 4,131,981 | A | | 1/1979 | Scott et al. | |
| 4,177,989 | A | | 12/1979 | Easton et al. | |
| 4,323,239 | A | * | 4/1982 | Ishii | 473/566 |
| 4,505,479 | A | | 3/1985 | Souders | |
| 4,931,247 | A | * | 6/1990 | Yeh | 264/258 |
| 5,365,095 | A | | 11/1994 | Shono et al. | |
| 5,380,003 | A | | 1/1995 | Lanctot | |
| 5,409,214 | A | * | 4/1995 | Cook | 473/564 |
| 5,511,777 | A | | 4/1996 | McNeely | |
| 5,593,158 | A | * | 1/1997 | Filice et al. | 473/520 |
| 5,711,728 | A | | 1/1998 | Marcelo | |
| 5,833,561 | A | | 11/1998 | Kennedy et al. | |
| 6,007,439 | A | | 12/1999 | MacKay, Jr. | |
| 6,022,282 | A | | 2/2000 | Kennedy et al. | |
| 6,045,467 | A | * | 4/2000 | Anderson | 473/568 |
| 6,056,655 | A | | 5/2000 | Feeney et al. | |
| 6,287,222 | B1 | | 9/2001 | Pitsenberger | |
| 6,334,825 | B1 | * | 1/2002 | Buiatti | 473/566 |
| 6,344,007 | B1 | * | 2/2002 | Feeney et al. | 473/567 |
| 6,612,945 | B1 | * | 9/2003 | Anderson | 473/566 |
| 6,743,127 | B2 | * | 6/2004 | Eggiman et al. | 473/567 |
| 6,767,299 | B1 | * | 7/2004 | Chang | 473/564 |
| 6,824,482 | B1 | * | 11/2004 | Tribble | 473/564 |

* cited by examiner

*Primary Examiner*—Mark S. Graham
(74) *Attorney, Agent, or Firm*—Perkins Coie LLP

(57) ABSTRACT

A ball bat includes an aluminum, or other metal, tubular sleeve co-molded or post-mold bonded onto a predominantly cylindrical composite, or other non-metal, ball bat handle. An aluminum, or other metal, knob is attached to the metal tubular sleeve, via welding or another suitable attachment method. A barrel end closure, e.g. a barrel cap, may be attached to the end of the bat barrel in a similar manner. In such a case, a metal insert is co-molded, or post-mold bonded, onto the barrel end of the bat. A metal barrel cap is then welded to the metal insert to close the end of the ball bat. Alternatively, a cap retention device may be co-molded, or post-mold bonded, onto the barrel end of the bat. A plastic, or other suitable material, cap is then attached to the cap retention device.

13 Claims, 2 Drawing Sheets

COMPOSITE BALL BAT HAVING A METAL KNOB

BACKGROUND OF THE INVENTION

Baseball and softball bat manufacturers are continually attempting to develop low cost, lightweight ball bats that exhibit excellent durability and performance characteristics. Ball bats typically include a handle, a barrel, and a tapered section joining the handle to the barrel. A knob is typically attached to the free end of the handle, and a cap or other barrel closure is typically attached to the free end of the barrel. The outer shell of these bats is generally formed from aluminum or another suitable metal, and/or one or more composite materials.

Aluminum, or other metal, knobs are typically attached to metal ball bats via welding. Pins, screws, bolts, or other suitable attachment elements are alternatively used to attach the knobs to the bats. Aluminum knobs are desirable because they are durable, and are also relatively lightweight and inexpensive. Durability of a bat knob is important, as knobs are often subjected to stresses or forces when they are struck against a surface, such as when a batter slams the knob of a bat into the ground after striking out. Thus, aluminum knobs are generally preferred over less durable knobs in bat manufacturing.

Aluminum knobs cannot, however, be welded or otherwise readily attached to a composite, or other non-metal, bat handle. A common method for attaching a knob to a composite bat handle is to cast a polymer knob at the free end of the predominantly cylindrical bat handle. Structural integrity of the knob attachment is typically enhanced using one or more containment devices, such as pins and/or bolts.

The polymer knob is typically cast around the pins or bolts in order to improve the knob's structural performance. Unfortunately, the use of pins and bolts has a significant impact on the cost of manufacturing and the overall weight of the bat, and attaching a knob in this manner is a relatively lengthy process. Furthermore, polymer knobs are not nearly as durable as aluminum, or other metal, knobs. Thus, there is a need for a lightweight, low cost, durable knob that can be attached to a composite, or other non-metal, ball bat.

Attaching durable barrel caps to composite, or other non-metal, bats presents similar challenges. And barrel caps are more likely to be slammed into surfaces and struck by pitched balls, due to their location on the bat, than are bat knobs. Thus, there is also a need for a lightweight, low cost, durable barrel cap that can be attached to a composite, or other non-metal, ball bat.

SUMMARY OF THE INVENTION

The invention is directed to systems and methods for co-molding, or post-mold bonding, an aluminum, or other metal, tubular sleeve onto a predominantly cylindrical composite, or other non-metal, bat handle. An aluminum, or other metal, knob is attached to the metal tubular sleeve, via welding or another suitable attachment method. Similar methods may be used for attaching barrel end closures, e.g. barrel caps, to the end of the bat barrel. In these methods, a metal insert is co-molded or post-mold bonded onto the barrel of the bat. A metal barrel cap is then welded, or otherwise attached, to the metal insert to close the end of the bat. Alternatively, a cap retention device may be co-molded, or post-mold bonded, onto the barrel of the bat. A plastic, or other suitable material, cap is then attached to the cap retention device.

In a first aspect, a ball bat includes a metal sleeve co-molded onto a non-metal bat handle, such that the metal sleeve is integral with the bat handle. A metal knob is attached to the metal sleeve, preferably via a weld. One or more screws, or another suitable attachment device, may alternatively be used to attach the metal knob to the metal sleeve.

In another aspect, a metal insert is co-molded onto the bat barrel. A metal cap is attached to the metal insert, preferably via a weld or another suitable attachment device.

In another aspect, a cap retention device is co-molded onto the bat barrel. A plastic cap, or other suitable cap, is attached to the cap retention device.

In another aspect, the metal sleeve is positioned at least 0.25 inches from a terminal end of the bat handle.

In another aspect, the metal sleeve has a length of 0.25 to 2.0 inches.

In another aspect, the metal sleeve has a thickness of 0.02 to 0.07 inches.

In another aspect, a ball bat includes a metal sleeve bonded onto a non-metal handle, and a metal knob attached to the metal sleeve.

In another aspect, a method of constructing a ball bat includes the steps of arranging non-metal layers of the ball bat onto a bat-shaped mold, placing a metal sleeve onto the handle section of the ball bat, and co-curing the layers of the ball bat and the metal sleeve to integrate the metal sleeve with the bat handle. A metal knob is then attached to the metal sleeve, preferably via welding. Screwing, or another suitable attachment method, may alternatively be used to attach the metal knob to the metal sleeve.

In another aspect, a method of constructing a ball bat includes the step of placing a metal insert onto the barrel section before the co-curing step, such that the metal insert is co-cured with the layers of the ball bat during the co-curing step.

In another aspect, a method of constructing a ball bat includes the step of attaching a metal cap to the metal insert after the co-curing step.

In another aspect, a method of constructing a ball bat includes the step of placing a cap retention device onto the barrel before the co-curing step, such that the cap retention device is co-cured with the layers of the ball bat during the co-curing step.

In another aspect, a method of constructing a ball bat includes the step of attaching a plastic cap to the cap retention device.

In another aspect, a method of constructing a ball bat includes the steps of arranging non-metal layers of the ball bat onto a bat-shaped mold, curing the layers of the ball bat, and bonding a metal sleeve onto the handle section. A metal knob is then attached to the metal sleeve, preferably via welding. Screwing, or another suitable attachment method, may alternatively be used to attach the metal knob to the metal sleeve.

Further embodiments, including modifications, variations, and enhancements of the invention, will become apparent. The invention resides as well in subcombinations of the features shown and described.

BRIEF DESCRIPTION OF THE DRAWINGS

In the drawings, wherein the same reference number indicates the same element throughout the several views.

DETAILED DESCRIPTION OF THE DRAWINGS

Figure 1:
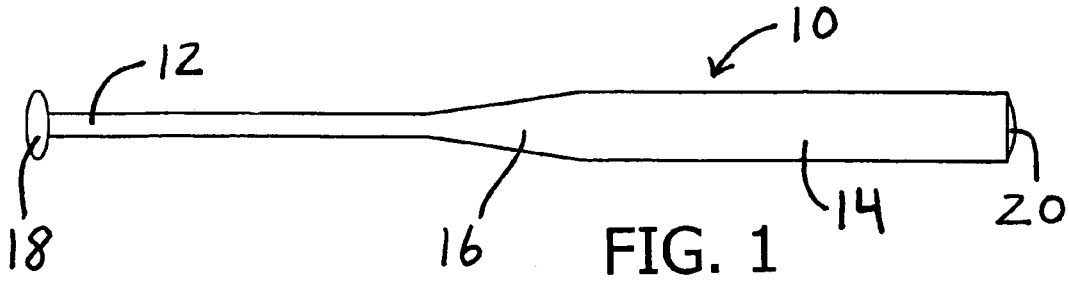
FIG. 1 is a perspective view of a ball bat.
Figure 2:
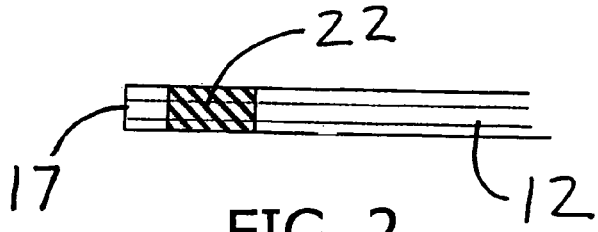
FIG. 2 is a side view of a non-metal bat handle with a metal sleeve positioned around the handle.
Figure 3:
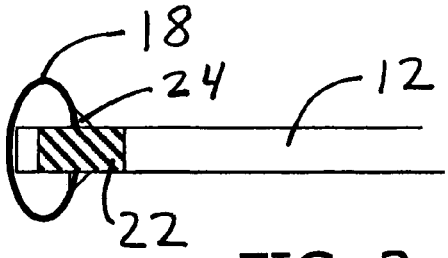
FIG. 3 is a partial side-sectional view of the bat handle illustrated in FIG. 2 with a metal knob attached to the metal sleeve.

Turning now in detail to the drawings, as illustrated in FIGS. 1–3, a baseball or softball bat 10, hereinafter collectively referred to as a "ball bat" or "bat," includes a handle 12, a barrel 14, and a tapered section 16 joining the handle 12 to the barrel 14. A knob 18 or similar structure is attached to the free end 17 of the handle 12. The knob 18 is preferably aluminum, or another suitable metal. The barrel 14 is preferably closed off by a suitable cap 20 or plug. The cap may be aluminum, or another suitable metal, or it may be plastic or another suitable material. The manner in which the knob 18 and cap 20 are attached to the bat 10 is described in detail below. The interior of the ball bat 10 is preferably hollow, which allows the ball bat 10 to be relatively lightweight so that ball players may generate substantial bat speed when swinging the bat 10.

The ball bat 10 preferably has an overall length of 20 to 40 inches, more preferably 26 to 34 inches. The overall barrel diameter is preferably 2.0 to 3.0 inches, more preferably 2.25 to 2.75 inches. Typical bats have diameters of 2.25, 2.69, or 2.75 inches. Bats having various combinations of these overall lengths and barrel diameters, as well as other sizes, are contemplated herein. The specific preferred combination of bat dimensions is generally dictated by the user of the bat 10, and may vary greatly between users.

The barrel 14 is preferably made up of one or more substantially cylindrical layers. The actual shape of each barrel layer may vary according to the desired shape of the overall barrel structure. The barrel 14 may include a single wall, or two or more walls. U.S. Pat. No. 5,364,095, which is herein incorporated by reference, describes a variety of bats having multi-walled barrel constructions.

The barrel, handle, and tapered section preferably each include one or more composite plies, or one or more layers of another suitable non-metallic material. The composite materials are preferably fiber-reinforced, and may include glass, graphite, boron, carbon, aramid, ceramic, kevlar, and/or any other suitable reinforcement material.

A tubular metal sleeve 22 or cylinder is preferably co-molded onto the outer diameter of the composite (or other non-metal) bat handle 12, as described below, such that the metal sleeve 22 is integral with the bat handle 12. The metal sleeve 22 is preferably made of aluminum and/or another suitable metal.

The metal knob 18 is attached to the metal sleeve 22, preferably via a weld 24, one or more screws or pins, or another suitable attachment device. Welding is the preferred attachment method, as welding is generally faster and cheaper than the other attachment methods. For example, welding a metal knob 18 onto a metal sleeve 22 typically takes approximately five seconds, whereas drilling holes into the knob and handle, to facilitate attachment of the knob via screws or pins, typically takes several minutes. Additionally, the cost of the screws or pins is saved when the knob 18 is welded onto the metal sleeve 22.

In an alternative embodiment, the metal sleeve 22 is bonded onto the handle 12 after the molding or curing process is performed on the bat 10. The metal sleeve 22 may be bonded to the handle 12 with adhesive, epoxy, or another suitable bonding agent. The metal knob 18 is then attached to the metal sleeve 22 via welding or another suitable attachment method, as described above. When this post-mold bonding method is used, a bond interface forms between the metal sleeve 22 and the handle 12, which results in the attachment between the metal sleeve 22 and the handle 12 not being as strong as the integration provided by the co-molded embodiment described above. Thus, the co-molding method is preferred over the post-mold bonding method, because the metal sleeve 22 becomes integrated with or encapsulated by the composite (or other non-metal) handle 12, which provides a stronger integration than the post-mold bonding method.

The metal sleeve 22 is preferably positioned at least 0.25 inches from the terminal end 17 of the bat handle 12, to provide sufficient shear strength against pullout loading, i.e., to prevent the metal sleeve 22 from shearing off of the handle 12 under loading conditions. The metal sleeve 22 may alternatively be located closer to the terminal end 17 of the handle 12, since the co-molding and post-mold bonding processes both provide a secure integration or attachment. From a design standpoint, however, it is preferable to locate the metal sleeve 22 at least 0.25 inches from the terminal end 17 of the bat handle 12, since the knob 18 can be attached to the metal sleeve 22 at a position that is distal from the terminal end 17 of the ball bat 10, as shown in FIG. 3, and the metal sleeve 22 therefore does not need to be located at the extreme end of the handle 12.

The metal sleeve 22 or cylinder preferably has a length of 0.25 to 12.0 inches, more preferably 0.25 to 2.0 inches, and a thickness of 0.02 to 0.07 inches, more preferably 0.05 to 0.07 inches. The diameter of the metal sleeve is generally determined by the outer diameter of the bat handle 12. For example, on a softball bat 10 having a 0.810 inch diameter handle 12, in the co-molding embodiment, the metal sleeve 22 preferably also has an outer diameter of approximately 0.810 inches, so that the outer surface of the metal sleeve 22 is substantially flush with the outer surface of the bat handle 12.

In the post-mold bonding embodiment, the metal sleeve 22 may have the same outer diameter as the bat handle 12 (in which case the actual handle portion beneath the metal sleeve 22 would have a slightly smaller diameter), or it may have a slightly larger diameter. For example, on a bat with a 0.810 inch diameter handle 12, the metal sleeve 22 may have an outer diameter of approximately 0.865 to 0.880 inches, and an inner diameter slightly greater than the 0.810 inch diameter of the handle 12, so that the metal sleeve 22 can be slipped onto the handle 12 after the molding or curing process. The metal sleeve 22 may be sized to fit on any size bat handle 12.

Figure 4:
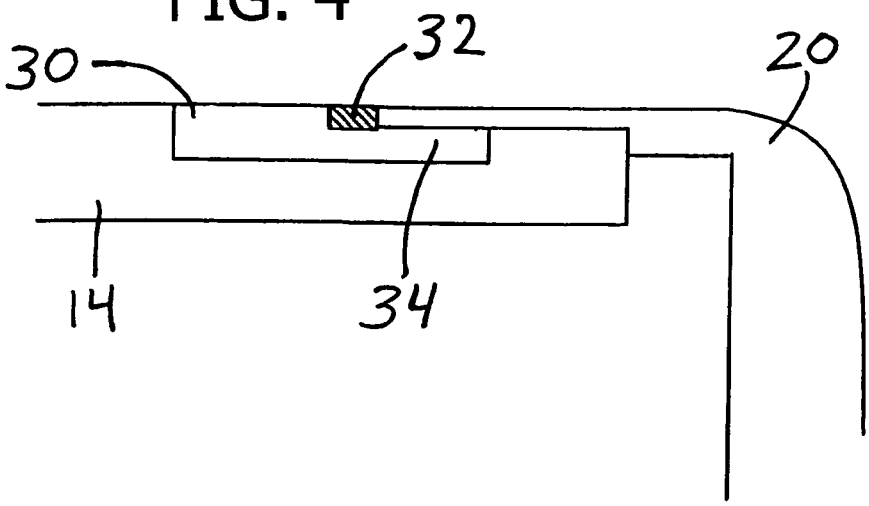
FIG. 4 is a partial side-sectional view of a non-metal bat barrel including a metal insert, with a metal barrel cap attached to the metal insert.

As illustrated in FIG. 4, an aluminum, or other metal, barrel cap 20 may be attached to a composite, or other non-metal, bat barrel 14 in a manner similar to that described above for attaching a metal knob 18 to a non-metal bat handle 12. In this embodiment, a metal insert 30 is preferably co-molded onto or into the composite (or other non-metal) bat barrel 14, as described below, such that the metal insert 30 is integral with the bat barrel 14. The metal insert 30 is preferably made of aluminum and/or another suitable metal.

A metal barrel cap 20 is attached to the metal insert 30, preferably via a weld 32, one or more screws or pins, or another suitable attachment device. Welding, which is generally faster and cheaper than the other attachment methods, is the preferred attachment method, as described above. The metal insert 30 preferably includes a recessed portion 34 beginning at the barrel cap 20 attachment or weld point, so that the outer surface of the barrel cap 20 may be flush with the outer surface of the bat barrel 14 after attachment. Other barrel cap and metal insert shapes may alternatively be used.

In an alternative embodiment, the metal insert 30 is bonded onto the barrel 14, with adhesive, epoxy, or another suitable bonding agent, after the molding or curing process is performed on the bat 10. The barrel cap 20 is then attached to the metal insert 30 as described above. In this embodiment, a bond interface is formed between the metal insert 30 and the barrel 14, which results in the attachment between the metal insert 30 and the barrel 14 not being as strong as the integration provided by the co-molded embodiment described above. Thus, the co-molding method is preferred over the post-mold bonding method, because the metal insert 30 becomes integrated with or encapsulated by the composite (or other non-metal) barrel 14, which provides a stronger integration than the post-mold bonding attachment method.

Figure 5:
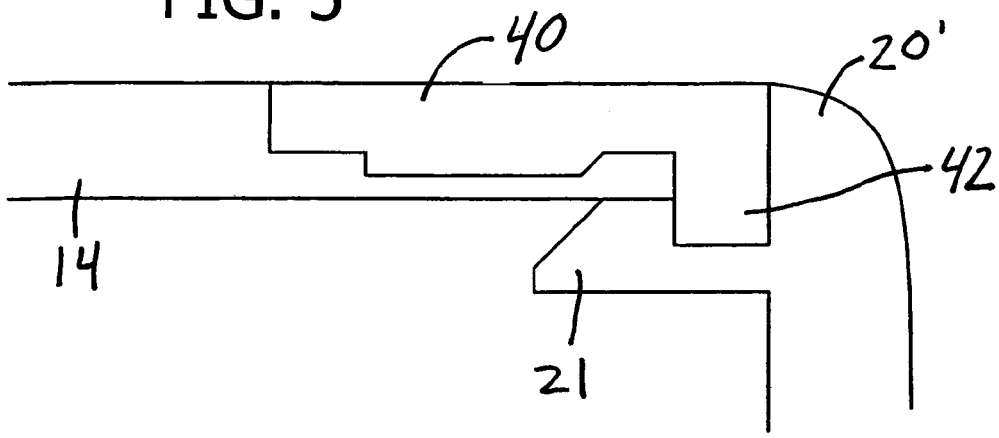
FIG. 5 is a partial side-sectional view of a non-metal bat barrel including a cap retention device, with a barrel cap attached to the cap retention device.

In another alternative embodiment, a cap retention device 40 is co-molded onto or into the composite (or other non-metal) bat barrel 14, as described below, such that the cap retention device 40 is integral and flush with the bat barrel 14. The cap retention device 40 may alternatively be bonded onto the barrel 14, with adhesive, epoxy, or another suitable bonding agent, after the molding or curing process is performed on the bat 10. The cap retention device 40 is preferably made of aluminum and/or another suitable metal, or another durable material. The cap retention device 40 may be a forged end of the barrel 14, a snap ring, or another suitable retention device. A plastic, or other suitable material, barrel cap 20' is attached to the cap retention device 40. In the embodiment illustrated in FIG. 5, a flexible arm 21 of the barrel cap 20' slides over and snaps behind a radially inwardly extending portion 42 of the cap retention device 40. Other suitable means or methods of attachment may alternatively or additionally be used.

The metal insert 30 or cap retention device 40 preferably has a length of 0.25 to 4.0 inches, more preferably 0.25 to 1.0 inch, and a thickness of 0.02 to 0.07 inches, more preferably 0.05 to 0.07 inches. The outer diameter of the metal insert 30 or cap retention device 40 is preferably the same as the outer diameter of the bat barrel 14, such that the outer surface of the metal insert 30 or cap retention device 40 is flush with the outer surface of the bat barrel 14. The metal insert 30 or cap retention device 40 may be sized to fit any size bat barrel 14.

One or more of the above described features may be used alone or in combination with one another. For example, a metal knob 18 may be attached to a metal sleeve 22 on the bat handle 12, and a metal cap 20 or a plastic cap 20' may be attached to a metal insert 30 or a cap retention device 40, respectively, on the bat barrel 14. Alternatively, only one of a metal knob 18 and a metal barrel cap 20 or a plastic barrel cap 20' may be attached to the composite, or other non-metal, ball bat 10. By using one or more of these features, bat durability is increased, while manufacturing costs and/or bat weight are reduced.

The ball bat 10 is generally constructed by rolling or arranging the various layers of the bat 10 onto a mandrel or similar bat-shaped mold, as described in U.S. patent application Ser. No. 10/336,130, filed Jan. 3, 2003, which is herein incorporated by reference. In the co-molding embodiments described above, once the composite, or other non-metal, layers of the ball bat are arranged onto the bat-shaped mold, a metal sleeve 22 is slipped or otherwise placed onto the handle section 12 of the ball bat 10, or the layers of the handle section are squeezed through the metal sleeve 22. Additionally or alternatively, a metal insert 30 or cap retention device 40 may be positioned or arranged onto or into the barrel section 14, as described above.

Internal pressure and/or heat are then applied to the ball bat 10 to co-cure or co-mold the layers of the ball bat 10, the metal sleeve 22, and/or the metal insert 30 or cap retention device 40 together. This co-curing process allows the composite, or other non-metal, material to encapsulate the metal sleeve 22 and/or the metal insert 30 or cap retention device 40, making them integral parts of the bat handle 12 and/or the bat barrel 14. Once the co-curing process is complete, and the bat 10 has sufficiently cooled, a metal knob 18 is welded or otherwise attached (e.g., by screwing or pinning) to the metal sleeve 22, as described above. If a metal insert 30 is co-cured with the bat barrel 14, a metal barrel cap 20 is subsequently welded or otherwise attached to the metal insert 30, as described above. If a cap retention device 40 is co-cured with the bat barrel 14, a plastic, or other suitable material, cap 20' is subsequently snapped onto or otherwise attached to the cap retention device 40, as described above.

In an alternative method of constructing the ball bat 10, the layers of the ball bat 10 are cured before the metal sleeve 22 and/or the metal insert 30 or cap retention device 40 are placed, slipped, or arranged on the ball bat 10. After the ball bat 10 has been cured and has sufficiently cooled, the metal sleeve 22 and/or the metal insert 30 or cap retention device 40 are positioned on the bat handle 12 or bat barrel 14, respectively, and are then bonded thereto with an adhesive, epoxy, or other suitable bonding agent. The metal knob 18 is then attached to the metal sleeve 22, and/or the metal cap 20 or plastic cap 20' is attached to the metal insert 30 or cap retention device 40, as described above. The co-curing methods are preferred over the post-mold bonding methods, however, because the metal sleeve 22 and/or the metal insert 30 or cap retention device 40 become integrated with or encapsulated by the composite (or other non-metal) handle 12 or barrel 14 during the co-curing methods, which provides a stronger integration than the post-mold bonding attachment methods.

The ball bat 10 described herein provides a more durable knob 18 and/or barrel cap 20 or 20' than that which is typically used on a composite, or other non-metal, ball bat. Additionally, the manufacturing costs and/or manufacturing time associated with the ball bat 10 are reduced, since the metal knob 18 and/or the metal cap 20 or plastic cap 20' may be attached via welding (or snapping, in the case of the plastic cap 20'), as opposed to using pins or screws, which is typically costly and time-consuming. Furthermore, the undesirable weight provided by pins or screws is avoided when the metal knob 18 and/or the metal cap 20 or plastic cap 20' are attached via welding or snapping.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a fiber-reinforced composite barrel;

a fiber-reinforced composite handle joined to the barrel;

a metal sleeve integrally molded with the composite handle, wherein the metal sleeve has a length of 0.25 to 2.0 inches; and a metal knob attached to the metal sleeve.

2. The ball bat of claim 1 wherein the handle and the barrel each comprise the same composite material.

3. The ball bat of claim 1 wherein the composite barrel and handle each include at least one material selected from the group consisting of glass, graphite, boron, carbon, aramid, ceramic, and kevlar.

4. The ball bat of claim 1 wherein the knob comprises aluminum.

5. The ball bat of claim 1 wherein the knob is welded to the metal sleeve.

6. The ball bat of claim 1 wherein the knob is attached to the metal sleeve with a screw.

7. The bail bat of claim 1 further comprising a metal insert integrated with the fiber-reinforced composite barrel.

8. The ball bat of claim 7 further comprising a metal cap attached to the metal insert.

9. The ball bat of claim 8 wherein the cap is welded to the metal insert.

10. The ball bat of claim 1 further comprising a metal cap retention device integrated with the fiber-reinforced composite barrel.

11. The ball bat of claim 10 further comprising a plastic cap attached to the cap retention device.

12. The ball bat of claim 1 wherein the metal sleeve is positioned at least 0.25 inches from a terminal end of the handle.

13. The ball bat of claim 1 wherein the metal sleeve has a thickness of 0.02 to 0.07 inches.

* * * * *

UNITED STATES PATENT AND TRADEMARK OFFICE

CERTIFICATE OF CORRECTION

PATENT NO. : 6,991,551 B1
APPLICATION NO. : 10/753649
DATED : January 31, 2006
INVENTOR(S) : Danny Tolentino et al.

It is certified that error appears in the above-identified patent and that said Letters Patent is hereby corrected as shown below:

Column 7,
Line 17, replace “bail” with -- ball --.

Signed and Sealed this

Twenty-fifth Day of July, 2006

JON W. DUDAS
*Director of the United States Patent and Trademark Office*